United States Patent [19]

Hiser

[11] 4,438,633

[45] Mar. 27, 1984

[54] METHOD AND APPARATUS FOR USING LOW GRADE THERMAL ENERGY TO IMPROVE EFFICIENCY OF AIR CONDITIONING AND REFRIGERATION SYSTEMS

[76] Inventor: Leland L. Hiser, P.O. Box 95, New Braunfels, Tex. 78130

[21] Appl. No.: 441,163

[22] Filed: Nov. 12, 1982

[51] Int. Cl.[3] ..... F25B 1/00

[52] U.S. Cl. ..... 62/116; 62/332; 62/500

[58] Field of Search ..... 62/500, 238, 4, 332, 62/191, 116, 117

[56] References Cited

U.S. PATENT DOCUMENTS

| | | | |
|---|---|---|---|
| 1,836,318 | 12/1931 | Gay | 62/116 |
| 3,496,735 | 2/1970 | Haisma | 62/191 X |
| 4,007,776 | 2/1977 | Alkasab | 62/500 X |
| 4,023,948 | 5/1977 | Pitts et al. | 62/191 |
| 4,024,908 | 5/1977 | Meckler | 165/18 |
| 4,123,003 | 10/1978 | Winston | 237/1 A |
| 4,128,124 | 12/1978 | Worthington | 165/48.5 |
| 4,173,994 | 11/1979 | Hiser | 165/48.5 |
| 4,242,885 | 1/1981 | Quack et al. | 62/500 |

*Primary Examiner*—William E. Wayner

*Attorney, Agent, or Firm*—Gunn, Lee & Jackson

[57] ABSTRACT

A method and apparatus for utilizing low grade thermal energy is shown to reduce the energy required to drive the compressor of a refrigeration or air conditioning system. The thermal energy is used to vaporize a fluid which is used as a motive fluid to drive a thermal compressor, such as a jet compressor or a vapor compression cycle compressor. In a normal air conditioning system including a condenser, expansion valve, evaporator and compressor, the jet compressor is inserted between the discharge of a compressor and the inlet for the condenser when there is sufficient thermal energy to drive a thermal compressor. This produces a two-stage compressor which improves the efficiency of the overall system. If separate fluids are utilized, a thermal evaporator is located in a heat exchange relationship with the condenser to cool the refrigerant fluid within the condenser tube, a tube-in-tube arrangement being such a heat exchange relationship.

16 Claims, 4 Drawing Figures

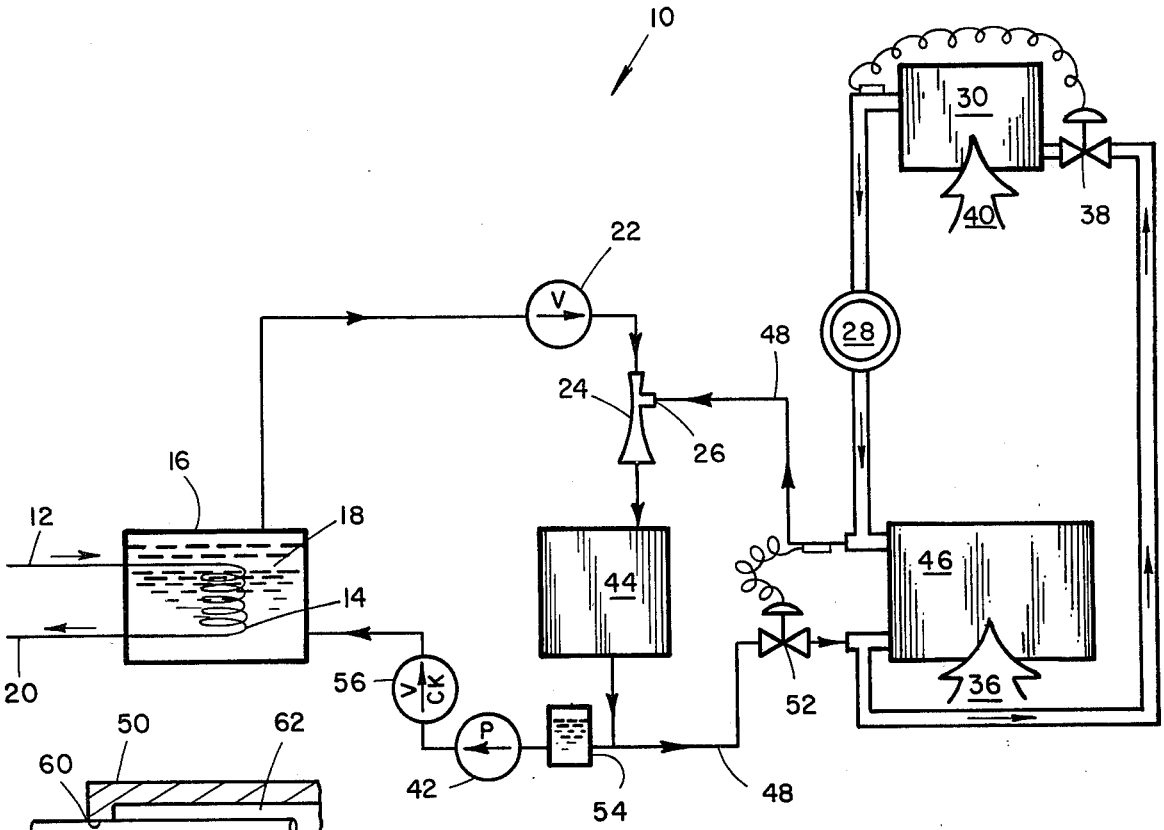
FIG. 2
FIG. 4
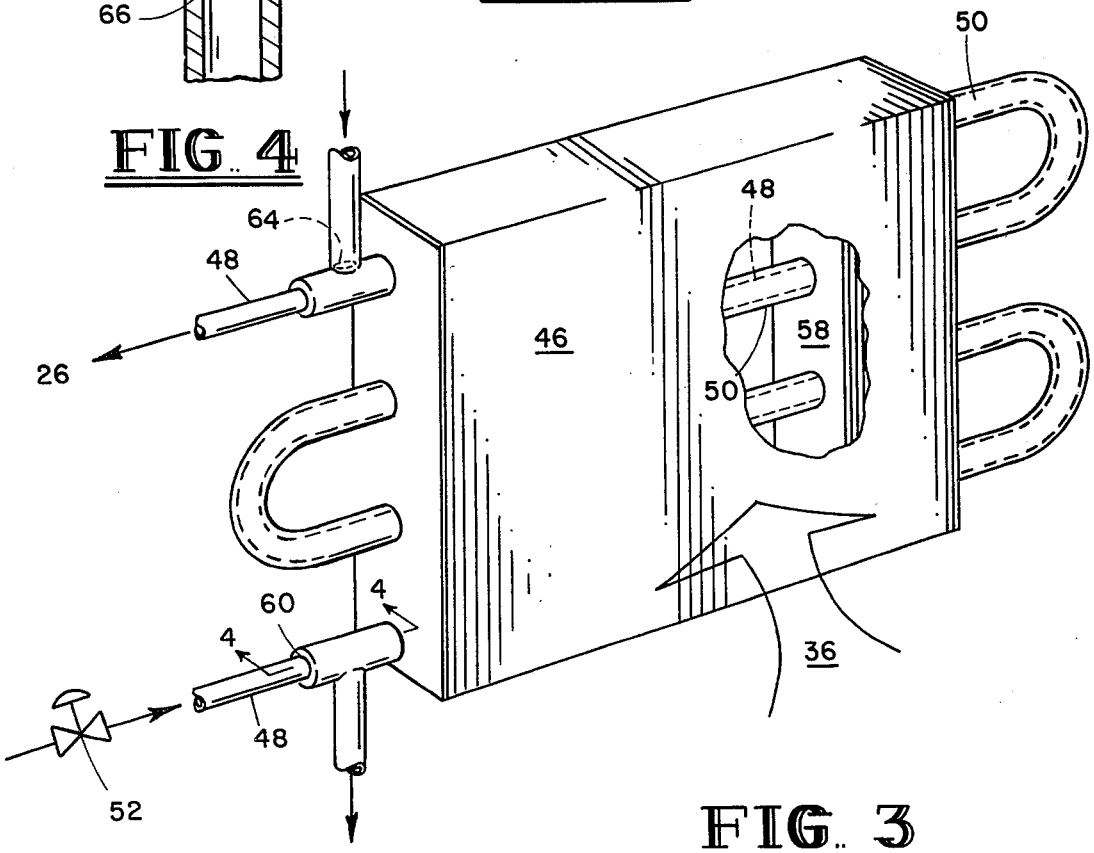
FIG. 3

METHOD AND APPARATUS FOR USING LOW GRADE THERMAL ENERGY TO IMPROVE EFFICIENCY OF AIR CONDITIONING AND REFRIGERATION SYSTEMS

BACKGROUND OF THE INVENTION

A standard refrigeration or air conditioning system includes an evaporator or cooling unit, a compressor, a condenser, and an expansion valve. A refrigerant circulates through these component parts with the refrigerant being under high pressure and converted to a liquid stage in a condenser. A pressure reduction or expansion valve allows the liquid fluid to flow into the evaporator wherein the pressure is greatly reduced and the liquid refrigerant is converted to a vapor state. A compressor creates a vacuum on the discharge of the evaporator to draw the vaporized fluid therein and to pressurize the vapor prior to flowing into the condenser. The cycle is repeated for continued cooling.

Within the condenser, heat is given off to the surrounding environment by any convenient means, such as having air flowing therethrough. In the evaporator, heat is absorbed from the surrounding environment, again a typical method being to have air flowing therethrough to cool an enclosed area.

In any standard refrigeration or air conditioning system, the compressor utilizes the most energy. The energy requirements of the compressor are nearly directly proportional to the pressure differential between the output of the evaporator and the input of the condenser. The requirements of the entire system can be reduced by merely reducing this pressure differential across the compressor.

The present invention decreases this pressure differential and the corresponding energy requirements by combining a standard refrigerant or air conditioning system with a thermal energy system adapted to work in series with the compressor to assume some of the compressor work load, or to condense the fluid in the condenser at a temperature lower than ambient. This decreases the temperature drop and pressure differential across the compressor. In the second case, the particular refrigeration or air conditioning system utilizes and comprises a thermal evaporator tube within a standard condenser tube. The evaporator tube has a thermal refrigerant therein and is in communication with the thermal energy system utilizing a thermal compressor, such as a jet compressor or a thermally driven vapor compression cycle compressor. The thermal jet compressor is activated by high pressure motive vapor from a thermal boiler or flash tank and draws a lower pressure from a thermal evaporator. The thermal evaporator, which may have a tube-in-tube connection within the condenser, allows the fluid contained within the thermal evaporator to absorb heat from the condenser refrigerant fluid.

If the motive vapor and the thermal refrigerant fluid are the same, the cycle is completed as the fluid from the thermal jet compressor is condensed and recycled back to the boiler or flash tank. If the thermal refrigerant fluid and the motive fluid are not the same, they are separated in an accumulator tank before being recycled to their respective systems. At those times where there is insufficient thermal energy to drive the jet compressor, the refrigerant or air conditioning system operates as a normal fin tube condenser permitting latent heat to be given off through the walls of the condenser tube to the ambient atmosphere flowing therethrough.

In one embodiment of the present invention, the thermal energy is simply used to boil and hence vaporize a refrigerant contained in the boiler, which vaporized refrigerant flows through an appropriate shut-off valve into a jet compressor. Upon reaching a predetermined pressure to open the shut-off valve, the vaporized fluid flows through the jet compressor to draw a lower pressure on the discharge side of the compressor. The output from the compressor then flows through the jet compressor and into the condenser. From the condenser, a portion of the condensed fluid will flow through an expansion valve or any other suitable expansion means into an evaporator with another portion being returned through a condensate return pump to the boiler. The compressor again pressurizes the vapor by drawing a vacuum on the outlet of the evaporator. Basically, this provides a two-step compression system which can increase the overall efficiency of the system several times.

BRIEF DESCRIPTION OF THE PRIOR ART

Various types of thermal energy powered heating and cooling systems are present in the prior art. For example, U.S. Pat. No. 4,173,994 issued to Hiser (the present inventor) discloses a method and apparatus for heating or cooling and utilizing solar energy. Hiser teaches the use of a solar powered jet compressor, a condenser and an evaporator, the evaporator comprising an outer tube in communication with the jet compressor and an inner tube in communication with an energy storage tank.

U.S. Pat. No. 4,123,003 issued to Winston discloses a solar powered air-water heat exchanger to provide a heat exchange relationship with a traditional heating and air conditioning system. Neither Hiser nor Winston suggests a thermal energy system to divide the compression load or to cool the fluid contained in a condenser of a standard refrigeration and air conditioning system, thereby increasing the efficiency of the air conditioning system.

U.S. Pat. No. 4,007,776 issued to Alkasab and U.S. Pat. No. 4,023,948 issued to Pitts et al. disclose the use of a solar powered jet compressor in order to create a suction for the evaporator. U.S. Pat. No. 4,024,908 issued to Meckler teaches an elaborate solar cooling system utilizing a number of heat exchangers and directed toward stratification of heat within the storage tank. U.S. Pat. No. 4,128,124 issued to Worthington discloses a multi-mode solar heating and cooling system directed toward evaporative cooling.

Once again, however, none of the above patents suggest the use of a thermal energy assisted cooling system to subcool the fluid contained in a condenser of a standard refrigeration or air conditioning system, or to act in series with the standard compressor to reduce pressure differential, thereby increasing the efficiency of the compressor.

SUMMARY OF THE INVENTION

It is an object of the present invention to provide a method and apparatus for utilizing thermal energy that would otherwise be wasted to reduce the electrical energy required for a ton of air conditioning or refrigeration.

Another object of the present invention is to utilize a jet or thermally driven vapor compression cycle compressor such as a reverse Carnot cycle compressor to assist or divide the total compressor work load of the standard compressor of an air conditioning system to increase overall efficiency.

Another object of the present invention is to utilize thermal energy, such as a jet compressor of a thermal energy system, to cool the fluid in a condenser of a standard vapor compression refrigeration or air conditioning system.

Still another object of the present invention is to increase the efficiency of vapor compression refrigeration or air conditioning systems by utilizing low level heat that would otherwise be wasted.

A further object of the present invention is to provide a method and apparatus for utilizing low grade thermal energy in combination with a standard cooling system whereby identical or different fluids may be used as a motive fluid for the thermal energy system and as refrigerant for other parts of the cooling system.

A still further object of the present invention is to provide a thermal energy cooling system which is capable of operating as a standard refrigeration or air conditioning system when there is an insufficient amount of thermal energy.

These and other objects are achieved in the present invention by combining a standard refrigeration air conditioning system with a thermal energy assisted cooling system. The standard refrigeration or air conditioning system includes an evaporator, compressor, condenser, and expansion valve, all of which are standard and have a standard refrigerant fluid flowing therethrough. In the standard system, the compressor would draw a vacuum in the evaporator and send the pressurized refrigerant vapor into the condenser for condensation into a liquid form. From the condenser the condensed refrigerant would flow through an expansion valve into the evaporator for converting to the vapor form. This cycle is repeated with the condenser giving off heat to the surrounding environment possibly with a fan drawing air through a fin tube condenser. In the evaporator, air is circulated therethrough for cooling as the evaporator absorbs heat from the surrounding atmosphere. However, the compressor continues to use the most energy.

In the first embodiment of the present invention, thermal energy such as may be received from solar collectors flows to a boiler to cause the fluid contained in the boiler to evaporate. Once a certain temperature or pressure inside the boiler is reached, an automatic shut-off valve will open and allow the pressurized vapor to flow through a jet compressor into a larger than standard condenser. While the automatic shut-off valve will be described hereinbelow as operable when a certain pressure is reached in the boiler, it should be realized that the automatic shut-off valve may also be operated by boiler temperature. The suction side of the jet compressor takes the output of a standard compressor for further pressurization inside of the jet compressor so there is a two-stage compression system, one stage being provided by thermal energy that would otherwise be wasted. The output from the condenser flows either through an expansion valve into an evaporator, or through a pump back to the boiler. The portion flowing through the expansion valve into the evaporator is changed to a vapor form in the evaporator, which vaporization process is used to cool the surrounding environment. The compressor draws a lower pressure from the output of the evaporator to repeat the cycle. During periods when there is insufficient thermal energy to operate the jet compressor, the automatic shut-off valve closes and a check valve will open so that the output of the compressor bypasses the jet compressor by flowing through the check valve into the condenser. On such occasions when there is insufficient thermal energy to operate the jet compressor, the system operates as a standard refrigeration or air conditioning system.

In another embodiment of the present invention, thermal energy is again fed through a heat exchange relationship to a boiler. A thermal refrigerant is vaporized inside the boiler so that when a sufficient amount of pressure is generated inside the boiler, an automatic shut-off valve is opened to allow the vaporized thermal fluid to flow through a jet compressor into a thermal condenser. The suction side of the jet compressor is connected to a thermal evaporator which is in a heat exchange relationship with the standard condenser. From the thermal condenser, the thermal refrigerant is collected in an accumulator with a portion flowing therefrom through a thermal expansion valve into the thermal evaporator, and another portion flowing through a pump and check valve arrangement back to the boiler.

The standard refrigeration system is basically the same as prior refrigeration systems with the exception of the heat exchange relationship with the thermal evaporator. While different types of heat exchange relationships may be used, a tube-in-tube arrangement is found to be the most desirable with the thermal fluid flowing into an inner tube of the combined thermal evaporator/standard condenser and the standard refrigeration fluid flowing into an outer tube. The thermal fluid flows in the opposite direction from the refrigerant fluid. This allows the maximum heat exchange between the fluids to cool the refrigeration fluid contained in the standard condenser. This reduces the pressure differential across the standard compressor. During periods when there is insufficient thermal energy, since the standard refrigeration fluid is in the outer tube, the standard refrigeration system can operate with the condenser being a standard fin tube condenser.

Still further objects will be apparent as the method and apparatus for improving the use of thermal energy and air conditioning and refrigeration systems is described in greater detail hereinbelow.

BRIEF DESCRIPTION OF THE DRAWINGS

FIG. 2 is a schematic diagram of the second embodiment of the present invention utilizing low grade thermal energy in combination with the standard refrigeration system to increase overall efficiency of the system while maintaining two separate fluids therein.

FIG. 3 is a perspective view of a condenser combining a thermal evaporator with a standard finned tube condenser in a tube-in-tube arrangement.

FIG. 4 is a cross-sectional view taken along section lines 4—4 of FIG. 3 showing the tube-in-tube arrangement with the thermal evaporator and the standard condenser.

DESCRIPTION OF THE PREFERRED EMBODIMENT

Figure 1:
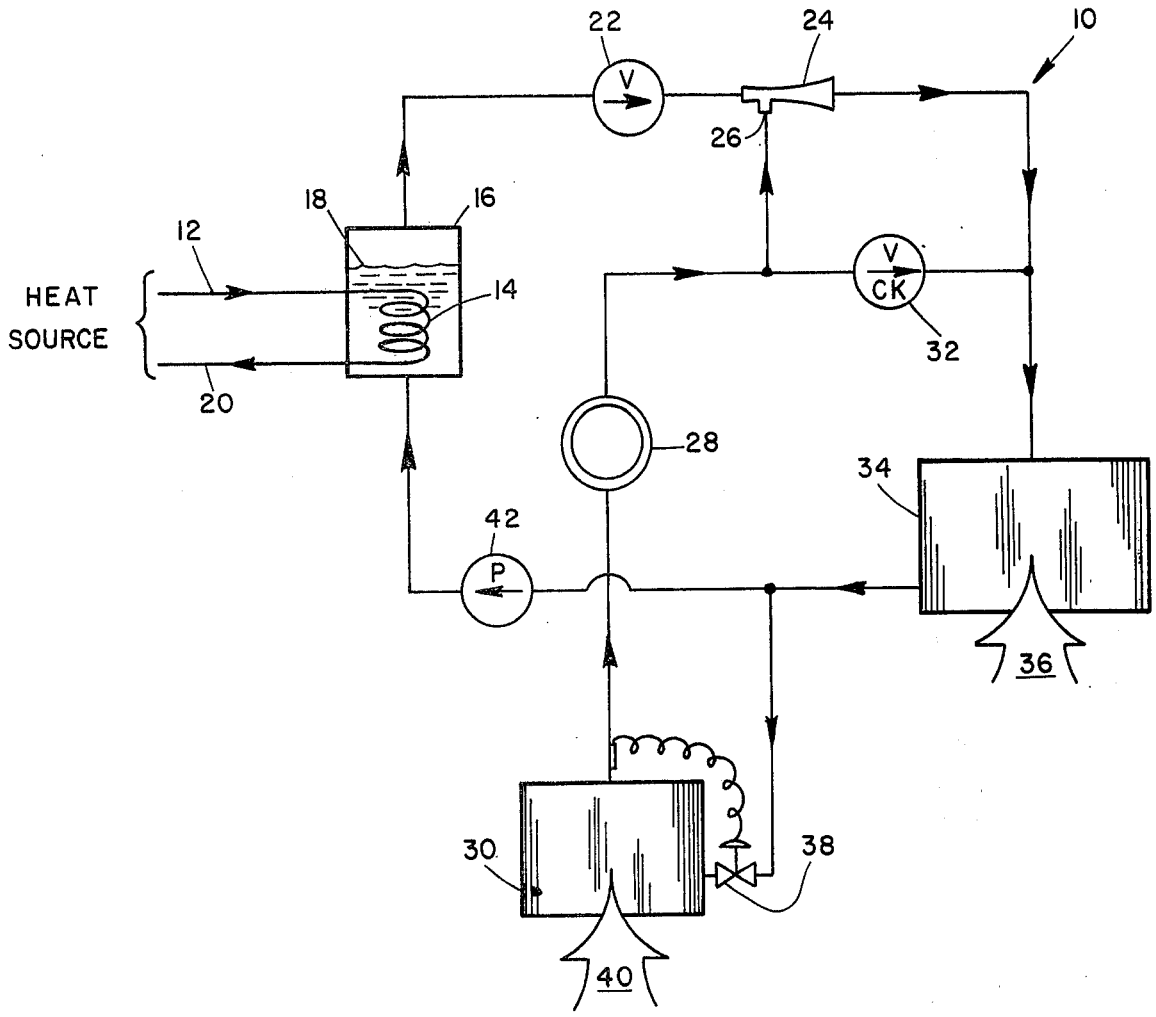
FIG. 1 is a schematic diagram illustrating the use of low grade thermal energy in combination with a standard refrigeration or air conditioning system to increase overall efficiency.

Referring now to FIG. 1 of the drawings, a low grade thermal energy assisted air conditioning system is shown, which air conditioning system is identified generally by reference numeral 10. The heat source of the low grade thermal energy may be of any suitable type, such as waste heat, geothermal or solar energy. For example, if solar energy is utilized to heat a solar fluid, the heated solar fluid would flow through inlet conduit 12 into coils 14 located inside of boiler 16. The heat from the solar fluid is transferred via coils 14 to the thermal fluid 18 prior to the solar fluid flowing out through outlet conduit 20.

The heat from the fluid flowing through coils 14 is used to boil the thermal fluid contained inside a boiler 16 to vaporize the thermal fluid. The vaporized thermal fluid upon reaching a predetermined temperature or pressure will open automatic shut-off valve 22 to allow the pressurized vapor to flow through the jet compressor 24. The flowing of the vaporized thermal fluid through the jet compressor 24 creates a low pressure on the suction inlet 26.

A standard air conditioning compressor 28 pressurizes a vapor received from evaporator 30. During periods of time when the jet compressor 24 is not operating because the shut-off valve 22 is closed, the pressurized vapor from compressor 28 flows through check valve 32 into condenser 34. Inside of the condenser 34 the pressurized vapor is condensed into a liquid form. Heat given off by the condensation of the vapor inside of condenser 34 is removed by the flow of air therethrough as represented pictorially by the arrow 36. From the condenser 34 the fluid flows through expansion valve 38 into the evaporator 30. The liquid flowing through expansion valve 38 into evaporator 30 is vaporized therein. During the vaporization process evaporator 30 absorbs heat from the surrounding environment, which is provided by the flow of air therethrough as pictorially represented by arrow 40. This cooling effect is used to air condition or refrigerate an enclosed space. From evaporator 30, the vapor is drawn into the compressor 28 by the suction pressure created by compressor 28.

When there is sufficient thermal energy or waste heat flowing through coils 14 to cause the thermal fluid to evaporate thereby creating enough pressure (or temperature) to open automatic shut-off valve 22, the output of the standard air conditioning compressor 28 is drawn into the jet compressor 24 through the suction inlet 26. Simultaneously, the check valve 32 will close. The vapor output from jet compressor 24 will condense inside condenser 34. The fluid output from condenser 34 will divide with a portion flowing through expansion valve 38 into evaporator 30, and another portion being returned to boiler 16 via pump 42.

By utilization of the system just described in conjunction with FIG. 1, when there is sufficient thermal energy to operate the jet compressor 24, a two-step compression system is provided with the operation of the second step through the jet compressor 24 being powered by waste heat. This reduces the pressure differential across the standard air conditioning compressor 28 and thereby reduces the energy requirement. It is necessary to include check valve 32 to prevent a backflow of the thermal fluid 18 from the condenser 34 when the jet compressor 24 is being utilized.

It should be realized that the thermal fluid 18 may be a standard refrigerant fluid with the particular refrigerant fluid being selected to meet the overall operating characteristics of the system.

The net result of the use of the two-stage compression system as described in FIG. 1 by utilizing waste heat, is that the compression workload is divided between the standard air conditioning compressor 28 and the jet compressor 24. This is accomplished by lowering the discharge pressure of the standard air conditioning compressor 28 and thereby lowering the pressure differential thereacross which reduces the energy requirement. The net capacity of the system is increased when the standard air conditioning compressor 28 does not have to work so hard and dissipate as much energy.

As a typical example, a conventional vapor compression air conditioning system using a refrigerant of Freon 12 is normally designed for an evaporating temperature of 40° F. and a condensing temperature of 100° F. Ambient air is normally used for heat rejection. Under these conditions, evaporator and condenser pressures are 51.7 psia and 139.9 psia, respectively. A theoretical horsepower of 0.67 is required per ton of air conditioning to drive the compressor. The compression ratio is 131.9/51.7=2.55. If this same compression workload were handled entirely by a jet compressor with a thermal boiler operating at 200° F., the jet compressor would draw 0.8 pounds of evaporator vapor per pound of motive vapor with the coefficient of performance being 0.4. However, if the work of compression is divided between the conventional compressor and the jet compressor so that the discharge pressure of the conventional compressor is 84.9 psia, then the jet compressor will draw 1.4 pounds of refrigerant per pound of motive vapor so that the coefficient of performance of the jet compressor is raised to 1.25. This essentially equals a tripling of the efficiency of the jet compressor. At the same time the compression ratio for the conventional compressor is reduced so that the horsepower requirements of the conventional compressor is cut in half.

Using the typical example as described hereinabove in conjunction with FIG. 1, the energy dissipated by the standard air conditioning compressor 28 is cut in half while the energy used to operate the jet compressor 24 is basically waste heat. Therefore, there can be a tremendous energy savings in operating the overall air conditioning during such times as there is sufficient waste heat to operate the jet compressor 24. For instance, the heat generated by the solar energy can be used to operate the jet compressor and thereby tremendously reduce energy requirements during peak daylight hours, which time is also a peak time wherein large amounts of cooling would be required.

Referring now to FIG. 2 of the drawings, like numerals will be used to designate like components as previously used in conjunction with FIG. 1. In FIG. 2 again waste heat such as may be provided from a solar collection system is provided through a fluid flowing through inlet conduit 12 into coils 14 and out outlet conduit 20. The flow of the heated fluid through the coils 14 heats the thermal fluid 18 contained therein which causes the thermal fluid to vaporize. Once the vaporized thermal fluid reaches sufficient pressure (or temperature), automatic shut-off valve 22 will open thereby allowing the vaporized thermal fluid to flow through jet compressor 24. The flow of the vaporized thermal fluid through jet compressor 24 creates a lower pressure on the suction inlet 26. The output of the jet compressor 24 is discharged into thermal condenser 44. Inside of thermal condenser 44 the vaporized thermal fluid is condensed to a liquid form by giving off heat to the surrounding environment such as air flowing therethrough.

Simultaneously the suction inlet 26 of the jet compressor 24 draws a low pressure on the suction side of an evaporator coil (which will be explained in further detail hereinbelow) that is contained inside of a combination thermal evaporator/condenser 46.

Referring to FIG. 3, the thermal evaporator portion of the thermal evaporator/condenser 46 is provided by an internal thermal evaporator tube 48 which is located inside of a condenser tube 50 so that the two fluids contained therein do not comingle. This will be explained in more detail subsequently.

The low pressure created by the suction inlet 26 causes the thermal fluid 18 contained inside of the thermal evaporator tube 48 of the thermal evaporator/condenser 46 to expand, evaporate, and absorb heat from the refrigerant contained in space 62 of condenser tube 50. The air does not circulate through the thermal evaporator/condenser 46 as indicated by the arrow 36 when the jet compressor of FIG. 2 is operating. Thermal fluid 18 flowing through the expansion valve 52 is received from the thermal condenser 44 or the accumulator tank 54. Basically, the accumulator tank 54 simply accumulates the thermal fluid as condensed by thermal condenser 44 to provide a ready supply of the thermal fluid 18 in a liquid form.

The portion of the thermal fluid 18 contained in accumulator tank 54 that is not utilized to circulate through expansion valve 52 into the thermal evaporator/condenser 46 will subsequently flow through pump 42 and check valve 56 back into the boiler 16. The cycle is then repeated with the thermal fluid 18 being vaporized again if sufficient waste heat is still provided through coils 14.

Simultaneously, the standard air conditioning compressor 28 is drawing a low pressure on the evaporator 30 to pressurize a vaporized refrigerant drawn therefrom. The pressurized refrigerant flows from the standard air conditioning compressor 28 into the condenser tube 50 of the thermal evaporator/condenser 46. The refrigerant is condensed inside of the condenser tube 50 of the thermal evaporator/condenser 46 by giving off heat to the surrounding environment. Heat may be given off either (1) to air flowing through the fins 58 (see FIG. 3), or (2) to the vaporized thermal fluid flowing through the thermal evaporator tube 48. Thereafter, the condensed refrigerant flows from the condenser tube 50 through the expansion valve 38 and back into the evaporator 30. The evaporator 30 absorbs heat from the surrounding environment by any of a number of ways, such as the flowing of air therethrough as pictorially represented by the arrow 40. This absorbtion of heat from the surrounding environment may then be utilized to cool or refrigerate an enclosed area.

Referring to FIGS. 3 and 4 in combination, the thermal evaporator tube 48 is received through opening 60 in an airtight manner into condenser tube 50. A space 62 is provided between the thermal evaporator tube 48 and the condenser tube 50 so that a tube-in-tube arrangement exists. The fluid contained inside of the thermal evaporator tube 48 does not mix or come in contact with the fluid contained inside of condenser tube 50. The pressurized vapor of the refrigerant fluid from standard air conditioning compressor 28 is received inside of the condenser tube 50 through opening 64. After condensation to a liquid form, the refrigerant is discharged from the condenser tube 50 through opening 66 (see FIG. 4) for subsequent flow to the expansion valve 38 (see FIG. 2).

The thermal fluid 18 is received into the thermal evaporator tube 48 from the expansion valve 52 as indicated in FIG. 3. After flowing through the thermal evaporator tube 48 in the tube-in-tube arrangement with the condenser tube 50, the thermal fluid which has been evaporated is drawn to the suction inlet 26 of the jet compressor 24. The evaporation process of the thermal fluid inside of the thermal evaporator tube 48 absorbs heat from the surrounding environment, which is principally the heat given off by the condenser tube 50 of the thermal evaporator/condenser 46. In the configuration as shown in FIG. 3 the thermal fluid 18 flowing through the thermal evaporator tube 48 flows in the opposite direction of the refrigerant flowing through condenser tube 50. This counter flow design permits the maximum heat transfer between the thermal fluid 18 and the refrigerant to get the maximum cooling effect of the refrigerant which is being pressurized by the standard air conditioning compressor 28.

In a typical example, when sufficient waste energy is available to boil the thermal fluid 18 which operates the jet compressor 24, the thermal evaporator tube 48 is cooled approximately 30° F. below the temperature of ambient air. The refrigerant fluid contained inside of condenser tube 50 is then condensed at a temperature considerably below ambient conditions due to the heat transfer with the thermal evaporator tube 48. This provides for the condensation of the refrigerant fluid at a lower temperature and, therefore, at a lower compressor head pressure than if condensation were at ambient temperature.

Using a refrigerant of Freon R22, an evaporator temperature of 40° F. and an evaporative pressure of 83.2 psi, the system as described in connection with FIGS. 2–4 will lower the condensing temperature of the refrigerant to approximately 70° F. Likewise, the condensing pressure is lowered from 210.6 psi to 136.1 psi which reduces the compression ratio from 2.53 to 1.64. Likewise, the theoretical horsepower required for a ton of air conditioning is reduced from 0.67 horsepower to 0.30 horsepower. This reduces to less than half the energy requirements of the compressor during periods of time that the jet compressor 24 is operating.

Combining the two refrigeration systems as described in connection with FIG. 2 likewise more than doubles the efficiency of the jet compressor 24. For example, the jet compressor 24 may be used to drive an air conditioning system having 40° F. evaporating temperature to 100° F. condensing temperature. Under these conditions using Freon R11 as the thermal fluid, a nominal motive fluid temperature will be approximately 250° F. with approximately 0.6 pounds of thermal fluid being evaporated per pound of motive fluid passing through the jet compressor 24. Under these conditions, the efficiency of performance of the jet compressor system is 0.45. However, if evaporator conditions are changed from 40° F. to 65° F. as occurs in connection with FIG. 2, approximately 1.3 pounds of thermal fluid will be removed per pound of motive fluid flowing through the jet compressor 24. Therefore, the coefficient of performance of the jet compressor system increases from 0.45 to 1.0, thereby more than doubling the efficiency of the jet compressor portion of the system.

By combining the two refrigeration systems as described hereinabove, the compression ratio of each compressor system is reduced, and the result is a more than two-fold increase in the efficiency of the combined system over each separate system by itself.

While the present system shows a separate fluid flowing through coils 14 to vaporize the thermal fluid 18, it should be realized that a single fluid could be used, such as direct flow from a solar collection system through the automatic shut-off valve 22 into the jet compressor 24. However, the present system is designed to be more encompassing so that it may be used with either a solar system or a waste or auxiliary heat system.

While the invention for improving the use of waste energy in air conditioning and refrigeration systems has been described in connection with the two foregoing embodiments, it is not intended to limit the invention to the particular forms set forth. To the contrary, it is intended to cover such alternatives, modifications, and equivalents as may be included within the spirit and the scope of the invention as defined by the appended claims.

I claim:

1. An air conditioning and refrigeration system comprising:

first compressor means;

condenser means for receiving a pressurized refrigerant in a vapor form from said first compressor means, said condenser means converting said vapor form to a liquid form by giving off heat;

expansion means receiving said liquid form of said refrigerant and allowing passage therethrough;

evaporator means receiving said refrigerant from said expansion means and converting said refrigerant to a vapor form by absorbing heat, said vapor being received by said first compressor means for pressurization prior to said receiving by said condenser means;

jet compressor means operated by an expanding vapor, said jet compressor flowing said expanding vapor therethrough to draw a lower pressure at a first orifice thereof, said first orifice being in operative communication with said first compressor means to reduce pressure across said first compressor means;

boiler means for vaporizing a fluid therein utilizing a heat source to provide said expanding vapor for said jet compressor means, said boiler means being in flow communication with said jet compressor means; and pump means for returning condensed fluid of said expanding vapor from said jet compressor means to said boiler means.

2. The air conditioning system of claim 1 wherein said vacuum from said first orifice is in flow communication with output side of said first compressor means, output from said jet compressor means being received by said condenser means and after condensation therein a portion flowing to said pump means.

3. The air conditioner of claim 2 including check valve means between said first compressor means and said condenser means, said check valve being in parallel with at least a portion of said jet compressor means.

4. The air conditioner of claim 1, 2 or 3 wherein said heat source is solar energy received from solar collection system.

5. The air conditioner of claim 4 including shut-off means for terminating flow to said jet compressor if there is an insufficient amount of energy from said heat source to operate said jet compressor.

6. The air conditioner of claim 1 wherein said pressurized refrigerant is a first refrigerant flowing through said first compressor means, condenser means, expansion means and evaporator means;

a second refrigerant flowing through said jet compressor means, pump means, and boiler means;

said second refrigerant being received from said jet compressor means in second condenser means prior to said returning to said boiler means through said pump means.

7. The air conditioner of claim 6 wherein said operative communication is a heat exchange relationship between second evaporator means and said first mentioned condenser means, said second evaporator means being connected on a first side to said first orifice and on a second side to said second condenser means for flow therebetween, said second evaporator means absorbing most of said heat given off by said first mentioned condenser means.

8. The air conditioner of claim 7 wherein said heat source is solar energy gathered by a solar collection system.

9. The air conditioner of claim 7 where said first mentioned condenser means and said second evaporator means have a tube-in-tube arrangement for said heat exchange relationship.

10. A method of air conditioning an enclosed area utilizing waste energy to increase efficiency of a standard air conditioning system including a first compressor, condenser, expansion means and evaporator consisting of the following steps:

converting waste heat into a vaporized thermal fluid by boiler means;

regulating pressure of said vaporized thermal fluid by shut-off means to stop flow from said boiler means therethrough if a predetermined temperature or pressure is not maintained;

injecting said vaporized thermal fluid into jet compressor means for flow therethrough if said predetermined temperature or pressure is maintained, said jet compressor means drawing a lower pressure at a suction port thereof;

pressurizing of a refrigerant by said first compressor;

first condensing said refrigerant in said condenser;

evaporation of said refrigerant by absorbing latent heat in said evaporator with said expansion means controlling flow therethrough and said first compressor drawing a low pressure thereon;

ejecting said thermal fluid from said jet compressor means so that said suction port is in operative communication with said first compressor to reduce pressure across said first compressor;

second condensing of said thermal fluid; and returning said condensed thermal fluid to said boiler means.

11. The method as recited in claim 10 wherein said thermal fluid and said refrigerant are the same with said suction port receiving said refrigerant from said first compressor for further pressurization by said ejection into said condenser, said first and second condensing being the same.

12. The method as recited in claim 11 wherein said returning step includes separating said condensed refrigerant from said condenser with a first portion flowing to said expansion means and a second portion being pumped back to said boiler means.

13. The method as recited in claim 11 wherein a check valve prevents backflow from said condenser to said suction port when said predetermined temperature or pressure has been reached.

14. The method as recited in claim 10 wherein said ejection step further including a second evaporation of said thermal fluid in a thermal evaporator, said thermal evaporator being in heat exchange relationship with said condenser to lower temperature of condensation in said condenser, said second condensing being in a second condenser.

15. The method as recited in claim 14 including the step of accumulating said condensed thermal fluid and pumping part of said condensed thermal fluid back to said boiler means, remainder of said condensed thermal fluid flowing through a second expansion means into said thermal evaporator.

16. The method as recited in claim 15 wherein said heat exchange relationship is provided by a tube-in-tube arrangement.

* * * * *